United States Patent [19]

Gilreath

[11] Patent Number: 4,983,487

[45] Date of Patent: Jan. 8, 1991

[54] IMAGE TRANSFER METHOD

[76] Inventor: Charles T. Gilreath, 217 N.W. 34th Dr., Gainesville, Fla. 32607

[21] Appl. No.: 414,588

[22] Filed: Sep. 18, 1989

Related U.S. Application Data

[63] Continuation of Ser. No. 850,288, Apr. 10, 1986, abandoned.

[51] Int. Cl.[5] ..... G03G 13/16

[52] U.S. Cl. ..... 430/126

[58] Field of Search ..... 430/126, 124

[56] References Cited

U.S. PATENT DOCUMENTS

| | | | |
|---|---|---|---|
| 2,661,289 | 12/1953 | Mayo et al. | 430/126 |
| 3,275,436 | 9/1966 | Mayer | 430/126 |
| 3,549,447 | 12/1970 | Bresnick | 430/126 |
| 3,716,360 | 2/1973 | Fukushima et al. | 430/126 |
| 3,999,481 | 12/1976 | Sankus et al. | 430/126 |
| 4,337,303 | 6/1982 | Sahyn et al. | 430/126 |

*Primary Examiner*—John L. Goodrow

[57] ABSTRACT

A method for transferring a fixed image, such as an electrographically produced toner image, from an initial substrate to a final substrate. The method employs an adhesive-coated film to lift the image from its initial substrate and to secure it to the final substrate. The film remains in place after the transfer is completed and serves to encapsulate and protect the image. Both the initial substrate and the adhesive-coated film are maintained dry during the process and the initial substrate remains intact and may be reused. Variations of the invention are disclosed whereby background or collage pieces may also be adhered to the adhesive coated film before the film is secured to the final substrate to thereby produce collages and special effects.

7 Claims, 1 Drawing Sheet

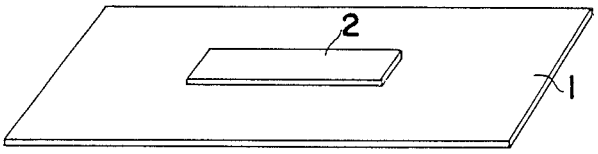
FIG.1
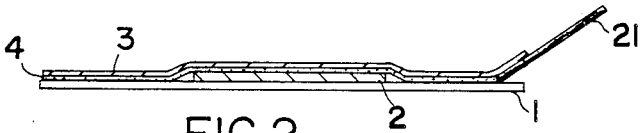
FIG.2
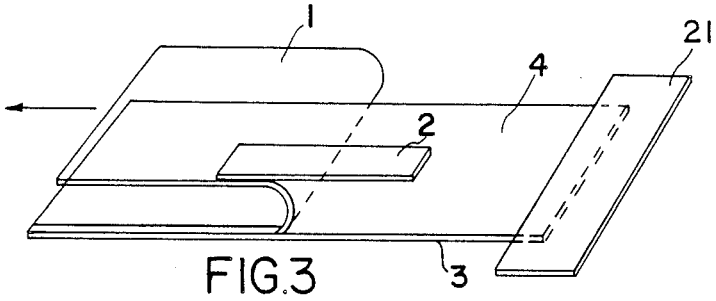
FIG.3
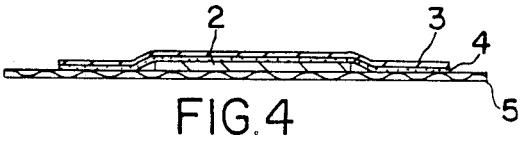
FIG.4
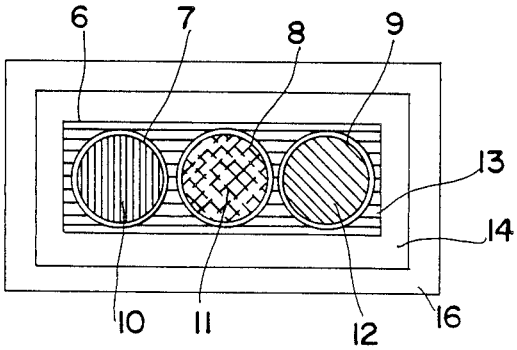
FIG.5
FIG.6
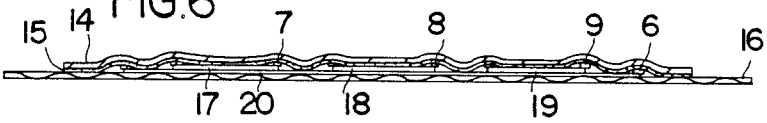

IMAGE TRANSFER METHOD

This application is a continuation of Ser. No. 850,288, filed Apr. 10, 1986 now abandoned.

BACKGROUND OF THE INVENTION

Numerous methods and patents are known which relate to the transfer and fixing of toner images and in some cases the encapsulation of those images as part of a process of electrography. One of those patents, U.S. Pat. No. 4,337,303 discloses a method for the development, transfer, encapsulation and fixing of a partially dried liquid toner image in an electrographic process. This method can be utilized only within an electrographic process under precise, limited conditions and cannot be employed to transfer and/or encapsulate, dried fixed images.

Other known processes by which words, symbols or art work can be transferred are limited to existing or predetermined symbols, words or other images and/or are extremely tedious and impractical. An example of a previous image transfer method utilizes so called dry transfer images. Basically these consist of individual letters and/or symbols with an adhesive backing which must be individually removed from a sheet containing many such letters or symbols and placed in the order and position desired. In order to produce a variety of signs, labels or the like, it is necessary to maintain large quantities of redundant characters and often a particular letter or symbol is not in stock even though a great quantity of materials are in inventory. Combinations of letters and symbols are also available but they must necessarily be limited in choice and number. The above products are usually available only in black or a very limited choice of colors. In addition, the work is tedious and the quality of the finished product depends on the skill of the person performing the work.

Another prior art system for transferring images is a wet process designed to transfer existing images from clay-coated papers. In that process an adhesive transfer film is applied to the image to be released and the assembly soaked in water. The softened paper is disintegrated to remove it from the adhesive film leaving the image on the film which can then be adhered to a new substrate to position and encapsulate the image. Problems with this technique are the time-consuming and messy operations of first soaking the complex in water for several minutes, then physically destroying the substrate by rubbing it off in pieces from the image-carrying transfer film. Finally, the debris must be cleaned up and the transfer film allowed to dry before it can be applied to a surface.

On the other hand the present invention requires no inventory of pre-formed symbols, can be used with virtually any form of image, and can be employed to produce composites, combinations and alternative forms, can create images in a variety of colors and may be employed without destroying or damaging the original. Another important advantage of the present invention over prior methods is that the original substrate sheet remains intact after images have been removed for transfer. This means that standard size sheets, such as loose-leaf sheets in a ring binder, can be used to inventory and selectively dispense images such as address labels without being cut up or otherwise destroyed in the transfer process. Unlike the wet process, the present invention does not expose the adhesive coating of the transfer film to water or to the abrasive action of direct rubbing to remove substrate particles.

This invention is applicable to any fixed image which is in a form that can be separated from the substrate on which it is carried or which can be reproduced in a form that can be separated from its substrate. Toner images which have been produced by electrography are desirable because they produce an excellent image when transferred and because of the great flexibility of the image which can be produced. It is possible also, when the original image is not separable from its substrate, or when it is desirable to preserve it, to produce an intermediate toner image by electrography from the original and then transfer and encapsulate the toner image as disclosed herein. Electrographically produced images also have the advantage of being duplicable in almost any number from a single original without destroying or harming the original, of being produced in black and white or color images and of being produced from a wide variety of two or even three dimensional images in a form which can be readily transferred in accordance with this invention. Electrography also provides a means of combining preexisting images into a composite or modified image which can then be utilized in the present process.

In the method of this invention it is desirable that an image to be transferred from one substrate to another be carried initially on a substrate from which it is readily separable. For this reason also electrographically produced images are desirable because they can be produced on image-releasing sheets from which they can be easily lifted by a transfer medium for transfer to a final substrate and encapsulation. Various paints, marking inks and other marking materials are available and suitable to produce a transferable image. It is possible also to add three dimensional objects which may be employed to produce collages.

The substrate from which the image is to be taken is preferably a material which will readily release the image to a transfer medium or laminator described below, which is employed to separate the image from its initial substrate and to transfer it to the final substrate. The transfer medium also serves as the laminator or encapsulating material, attaching the image to the final substrate and providing a protective cover over it. This transfer medium is preferably an adhesive material or a material provided with an adhesive coating which will adhere to the image to be transferred but which will separate readily from the initial substrate. For effective image transfer, the bond between the image and the adhesive on the transfer film must be stronger than the bond between the image and the initial substrate. The transfer medium should also be highly transparent and have good abrasion resistance and other characteristics which make it suitable for encapsulating the image in its position on the final substrate.

Xerographically produced toner images are good examples of the type of image suitable for transfer by the method disclosed. It is preferable that the toner image produced in the xerographic process for transfer according to this invention be produced on a suitable image-releasing sheet, several types of which are readily available. Smooth polyester films or similar products are suitable image-releasing substrates. A suitable transfer medium may be found among any of various transparent adhesive films or tapes. Those which have an adhesive that will readily adhere to a variety of surfaces, but which are removable without destroying the film or adhesive coating or the original image releasing substrate are preferable. As indicated above, the film should also have the desired transparency and abrasion resistance which will make it a good laminator.

The target image or image to be transferred and encapsulated is painted, printed or copied or otherwise applied by machine or manually to an image-releasing substrate. The adhesive side of an adhesive film or tape is applied over the image and lightly burnished to insure adhesion of the image to the adhesive coating on the film. The adhesive film with the image adhered to it is then lifted from the image-releasing substrate, separating the image from the substrate. The adhesive film and image are moved into position over the surface of the final substrate and the film is applied to the surface with the image in the desired position. The adhesive film is pressed onto the final substrate encapsulating the image in its desired position.

It is preferable that the transfer image remain physically discrete when formed on the releasing substrate, meaning that it is not absorbed or otherwise permanently bonded with the initial substrate and can be separated from the substrate by use of an adhesive film as herein described. One advantage of this invention is that images which have little cohesive integrity apart from the substrate which hold them are reserved intact when separated from their substrate by the transfer film. Of course, these properties will be affected in part by the ease with which the image can be released from the substrate. A fixed toner image has suitable characteristics, but images comprised of paint, resins, plastics or other materials may also be used. Furthermore, the images may be produced by typing, printing or electrography or may be manually drawn or printed or produced by any other means. This makes the process extremely versatile.

It can be seen that the method is applicable to a wide variety of images of various types produced by a wide variety of methods including machine or manual drawing and permits the transfer of these images to a wide variety of surfaces. In addition to the great versatility of the system, it is found that encapsulation of an image with a transparent film produces visual enhancement of the image as well as protection from abrasion and other damage.

It is an object of this invention to provide a method of transferring an image from an initial substrate to a desired final substrate.

It is another object of this invention to provide such a method employing known and readily available materials and means.

Still another object of this invention is to provide a method of transferring an image from an initial substrate to another substrate which method is extremely versatile and suitable for use with a wide variety of types and forms of images.

These and other objects, features and advantages of this invention will become apparent from the following description in conjunction with the accompanying drawings. The process by which the image to be transferred is created is not a part of this invention nor is this invention limited by the process by which such image was formed.

BRIEF DESCRIPTION OF THE DRAWINGS

FIG. 1 illustrates an image upon an image-releasing substrate.

FIG. 2 is a cross sectional view showing a transfer medium applied to the image in FIG. 1.

FIG. 3 illustrates separation of the initial substrate from the image.

FIG. 4 is a cross sectional view of the image in FIG. 1 after it has been transferred to a new substrate and encapsulated with the transfer medium.

FIG. 5 illustrates the completed collage composition described in Example 3.

FIG. 6 is a cross section taken along the line 6—6 in FIG. 5.

DETAILED DESCRIPTION OF THE INVENTION

The present invention provides a method of separating a physically discrete image from its initial substrate by attaching the image to a transfer medium, transferring the image to a desired position on a new substrate and employing the transfer medium to attach the image to the new substrate and encapsulate it.

Referring now to the drawings, the substrate 1 is a material with suitable image releasing characteristics on which an image 2 may be carried. Any available nonporous medium may be used as the initial carrier. Some examples are: smooth plastic such as a polyester or similar film, glass, ceramic tiles and polished metals. If the image is to be produced by xerography or other electrographic process, a medium which can be utilized in the pertinent equipment is required. An example of a medium for use in electrography is a clear reproduction film sold by Rayven, Inc., St. Paul, Minn., which will receive a good toner image and readily release it. Various films in the 300 and 400 series produced by this manufacturer will work in the process but numbers 400 and 420 appear to work best. The films made by Rayven, Inc., have an adhesive backing which is not necessary or useful in the present invention.

It is desirable to lift the image from its initial substrate using as a transfer medium a suitable transparent film 3 or tape which has on one side a pressure sensitive adhesive indicated by the numeral 4 in FIG. 2.

The initial substrate is laid on a flat, smooth surface with the image to be transferred facing upward. The transfer medium, such as a film or tape, is placed with its adhesive side over the image to be transferred and burnished lightly onto the image. The transfer medium is lifted from the initial substrate carrying with it the image to be transferred and is then placed with the image in the desired position over the final carrier or substrate 5 and adhered thereto. The transfer medium thus becomes a laminating material, attaching and encapsulating the image to the final substrate as shown in FIG. 4.

When the image to be transferred is too large for encapsulation with tape, a sheet film is used as will now be described. First, if the desired image is not on an image-releasing substrate, it is applied to an image-releasing substrate by electrography or other suitable process, such as hand marking, typing, painting, stamping or printing. A plotter or laser printer may be used to form transferable images directly on image-releasing film. The image is dried or otherwise fixed as necessary and the initial substrate is supported by a smooth surface with the image facing upward. Ordinarily, the surface would be flat but it can be seen that in certain special effects, the image may be produced on a carrier of other geometrical contour. If the adhesive has a backing sheet over it, the backing sheet is removed, exposing the adhesive. The transfer medium is then turned over so that the adhesive side faces the image to be transferred. The adhesive side of the film is moved into contact with the image and lightly burnished to insure good contact and adhesion to the image. Normally, this will also adhere the transfer medium to the initial substrate. The assembly is turned over so that the transfer medium is on the bottom and the initial substrate is peeled away from it.

It appears that the best images are produced and transferred if only the initial substrate bends during the separation. To assist in maintaining the transfer medium flat while the original substrate is peeled away, a substantially rigid frame may be temporarily adhered to the outer margins or edges of the adhesive side of the transfer medium. Alternatively, a flat plate 21 or functionally equivalent device may be temporarily adhered to one or more of the edges of the transfer medium during this part of the process. Of course, the frame or plate is removed when the image transfer has been completed. After the image has been transferred to the transfer medium, the transfer may be completed by adhering the transfer medium and image to the final substrate. If desired, the backing sheet may be replaced and transfer of the image to a final substrate performed at a later time.

To complete the transfer, the transfer medium 3 and image 2 are held over the desired position on the final substrate 5 with the adhesive side of the transfer medium toward the final substrate. The transfer medium is pressed onto and adhered to the final substrate attaching and encapsulating the image. The surplus portions of the transfer medium may be trimmed and discarded either before or after the transfer medium is affixed to the final substrate.

It has been found that the image quality of images produced electrographically on image-releasing film is of better quality if the film is dry. It is therefore desirable to store the film in a dehumidified cabinet or to warm it slightly before it is used. If necessary, the image may be touched up or filled in after it has been transferred to the laminator and before it is adhered to the final substrate. This can be done with a paint pen or with a marker designed for marking smooth films. Images transferred by the process are of better quality if air pockets, which interfere with the bond between the laminator and the toner image, are avoided. Attachment of stiffeners or reinforcing members to one or more edges of the transfer medium during the transfer operation and burnishing of the laminator to the image from the center to the outer edges will help avoid air pockets.

FIGS. 5 and 6 illustrate a variation of the process in which toner images are combined with background or collage pieces to produce a composite image as was done in Example 3 described below. To produce the completed image which resembles a traffic signal, a composite toner image was selected consisting of a rectangular outline 6 within with are positioned three circular outlines 7, 8 and 9. It was desired that each of the circular outlines have a different colored background 10, 11 and 12 respectively with the area 13, lying between the circular outlines and the rectangular border, being of another color. The cross-sectional view shown in FIG. 6 illustrates the construction of the completed product. One practical way of producing the desired product is to first construct an assembly of the desired circular and rectangular outlines and then to xerographically produce a composite toner image on an image-releasing film. The composite xerographic image is removed from the image-releasing film by applying a transfer medium 14 having an adhesive coating 15 on one side over the image and detaching the image-releasing film from the image and the transfer medium in accordance with this invention as described above. At the end of this procedure the transfer medium 14 is positioned with the adhesive side, to which is attached the toner image, facing upward. Round collage pieces 17, 18 and 19 displaying the colored backgrounds 10, 11 and 12 respectively desired for the circular outlines 7, 8 and 9 are pressed into place contacting the adhesive layer 15 of the transfer medium 14 so that they will be held in proper position. The rectangular collage piece 20 providing the colored background 13 is then similarly applied and the completed collage image is now ready for transfer to its final substrate 16. The adhesive side of the transfer medium 14 is placed in the proper position on the substrate 16 and burnished to adhere the completed collage composite image to the final substrate. Any excess portions of the transfer medium may be trimmed away and removed at this point.

Although we have included and defined toner images as physically discrete transferable images, they have in the prior art been considered inseparable from their substrate and the transfer of a toner image in the prior art has been accomplished only by also transferring at least a relevant portion of the substrate on which the image is carried.

The following examples further illustrate and help to describe the invention and its objects and advantages, but the particular materials and conditions recited in these examples as well as other details should not be construed to unduly limit the invention, which is defined in the claims.

EXAMPLE 1

It was desired to apply an image consisting of the letter "A" to the tab of a file folder in an alphabetical filing system. The desired letter was found on a non-image-releasing substrate and the desired toner image produced by copying the image on to Reprofilm 400. A clear pressure sensitive adhesive tape was applied over the desired toner image and the tape burnished slightly over the image to create an adhesive bond with the image. This procedure also caused the tape to adhere to the image-releasing film. The assembled tape and image-releasing film were turned over so that the image-releasing film was on top and the adhesive tape lay flat on a desk top. One end of the tape was held so that it maintained its position on the desk top and the image-releasing film peeled away from the end of the tape being held until the complete image was transferred from the image-releasing film to the adhesive tape. The tape with the image adhered to its adhesive side was moved in position over the tab of the file folder with the adhesive side toward the tab. The tape was applied to the tab and excess tape trimmed from the image. The exposed surface of the adhesive tape was burnished slightly to improve the adhesive bond between the tape and the file folder tab, securely attaching the image to the tab and encapsulating it.

EXAMPLE 2

In this example it was desired to apply the letter "A" to a file folder tab as in Example 1, but in this case the "A" is to be applied over a round red label for color coding purposes. A red label of appropriate size was first applied to the file folder tab at the desired position as a collage piece. The toner image of the letter "A" was produced on image-releasing film. The procedure described above in Example 1 was then followed to transfer the fixed toner image to the adhesive tape which served as a transfer medium, the tape being of a sufficient width to cover and encapsulate the red label. The tape and the toner image were applied to the file folder tab with the image centered over the red label. The tape was trimmed and burnished as described above in Example 1 to produce the completed, encapsulated collage image.

EXAMPLE 3

In this case it was desired to produce a collage product for application to a cylindrical coffee mug. The collage consisted of a composite toner image consisting of a rectangular outline within which are placed three linearally arranged adjacent circles. Each of the circles outlining a differently colored background or collage piece and the rectangular image outlining a colored background formed by a rectangular collage piece which also provides a background for the three circles. The completed collage product is shown in FIGS. 5 and 6.

First a master of the desired toner image outline was made by cutting out and gluing together existing rectangular and circular images of the appropriate size. This master was used to produce the composite toner image on an image-releasing film. In this case the image was larger than the available adhesive tape, so a sheet of adhesive-coated transparent film was employed as a transfer medium. The adhesive film had a protective backing which was removed and a flat straight edge was adhered to one margin of the film to permit better handling of the film and to help avoid the possibility of the sheet folding over and adhering to itself. The transfer film was then applied to the image on the image-releasing sheet and adhered thereto as described in Example 1. The assembly was turned over and the transfer film held flat on a desk top by means of the straight edge while the image-releasing sheet was pulled away from the adhesive, leaving the toner image attached to the transfer film. With the transfer film continued to be held in this position, red, orange and green round labels were applied as collage pieces fitting exactly within the three circles with the side desired to be viewed placed downward against the adhesive. A rectangular blue label was then added as a final collage piece behind the round ones and within the rectangular outline. The completed composition was then applied in the desired position on the coffee mug, the excess adhesive sheet trimmed off, leaving enough of the adhesive film around the edges of the collaged product to suitably adhere the composition to the coffee mug. Then the exposed surface of the film was burnished to obtain the desired smoothness and adhesion. The straight edge was removed with the excess transfer film.

What is claimed is:

1. A method for transferring a discrete toner image, which has been fixed and applied in a fusion process to a smooth and non-absorbent image-releasing substrate and which exists in a stable form outside of the process by which it was formed, from said image-releasing substrate to a final substrate, said method comprising the following:

(a) selecting a target image to be transferred, said target image having one surface fused with but substantially and integrally detachable from the initial substrate and having an exposed surface not in contact with the initial substrate and accessible from one side of the initial substrate, (b) contacting said exposed surface of the target image and areas of said initial substrate adjacent to said image with a pressure-sensitive adhesive coating carried on one side of a transparent film to cause adhesion of the target image to said film, (c) separating the film from the initial substrate, while maintaining adhesion of target image to said film to thereby detach substantially all of the target image from said initial substrate, (d) positioning the adhesive side of the film with the target image attached over the desired location on the final substrate, (e) adhering the film to the final substrate to attach the target image thereto and encapsulate it, (f) maintaining all of the materials substantially dry throughout the process, and (g) maintaining all of the materials substantially at ambient temperature.

2. A method as set forth in claim 1 wherein said target image (is a toner image which) has been fused to said initial substrate in a xerographic process, and said target image, when contacted with said adhesive coating and viewed from the uncoated side of said transparent film, appears as a reverse of the image held on the electrostatic plate used in said xerographic process.

3. A method as set forth in claim 1 comprising the additional step of attaching a substantially rigid plate to at least one margin of said transparent film to assist in handling said film.

4. A method as set forth in claim 1 wherein a background piece is applied to said adhesive coating in a superimposed layer over the target image before the film is adhered to the final substrate.

5. A method as set forth in claim 1 further comprising burnishing the other side of the transparent film after the adhesive coating has been placed in contact with the target image and before the transparent film has been separated from the initial substrate to obtain good contact between the target image and the adhesive coating.

6. A method as set forth in claim 1 wherein the series of steps (a), (b) and (c) are successively repeated with at least a second target image before step (d) is performed.

7. A method as set forth in claim 1 wherein said target image has been fused to said initial substrate in an ink-jet process.

* * * * *